United States Patent [19]

Buehl

[11] Patent Number: 4,605,369

[45] Date of Patent: Aug. 12, 1986

[54] RADIANT BURNER

[75] Inventor: Arnold L. Buehl, Solon, Ohio

[73] Assignee: Slyman Manufacturing Corporation, Cleveland, Ohio

[21] Appl. No.: 660,320

[22] Filed: Oct. 12, 1984

Related U.S. Application Data

[62] Division of Ser. No. 490,343, May 2, 1983.

[51] Int. Cl.[4] ..... F23D 13/12

[52] U.S. Cl. ..... 431/328

[58] Field of Search ..... 431/328, 329

[56] References Cited

U.S. PATENT DOCUMENTS

| | | | |
|---|---|---|---|
| 4,255,123 | 3/1981 | Bishilany et al. | 431/328 |
| 4,326,843 | 4/1982 | Smith | 431/328 |
| 4,354,823 | 10/1982 | Buehl et al. | 126/92 AC |
| 4,447,205 | 5/1984 | Smith | 431/328 |

*Primary Examiner*—Carroll B. Dority, Jr.

*Attorney, Agent, or Firm*—Pearne, Gordon, Sessions, McCoy, Granger & Tilberry

[57] ABSTRACT

A gas-fired burner of the radiant type includes a board-like heating element constituted by a porous matrix of refractory fibers, the periphery of one side of the heating element being bonded to and in fluidtight engagement with an open end of a sheet metal box functioning as a gas plenum. A combustible gas mixture is fed into the plenum and forced through the porous heating element for burning at the outer face thereof. The board-like heating element is retained in position by a strip of perforated metal fixed to the outer surface of the sheet metal box and extending about the edge of the heating element, the strip being bent over to hold the edge of the heating element against the box. A multilayer blanket of thermal insulating material wrapped around the sheet metal box is held in position by bent metal tabs and by the bent strip of perforated metal retaining the heating element. A low cost diffuser assembly ensures optimum gas mixture flow within the plenum.

4 Claims, 4 Drawing Figures

RADIANT BURNER

This is a division of application Ser. No. 490,343, filed May 2, 1983.

BACKGROUND OF THE INVENTION

The invention relates in general to gas-fired radiant burners, and in particular to an improved design for an infrared radiant burner of the type disclosed in U.S. Pat. No. 4,354,823, owned by the assignee of the present invention and incorporated herein in its entirety by reference.

U.S. Pat. No. 4,354,823 discloses a single-wall sheet metal box functioning as a gas plenum. The box has an open face closed by a porous, gas-permeable matrix of refractory fibers bonded together to form a rigid, boardlike heating element. A combustible gas mixture is fed into the box, forced through the porous heating element, and burned at the outer face thereof to provide a continuous infrared radiant surface.

The outer surface of the sheet metal box is completely covered by a blanket of flexible insulation material having an edge portion stuffed between the periphery of the heating element and an adjacent flange-like edge of the box.

A first type of snap-on clip maintains the heating element in position, while a second type of snap-on clip retains the stuffed edge of the insulation blanket between the heating element periphery and the adjacent edge of the box.

While the foregoing prior art radiant burner represents a substantial advance in the art, it is still rather complex and costly from both a materials and manufacturing standpoint.

For example, the use of numerous clips to maintain the heating element and insulation blanket in position on the plenum box requires a fairly complex manufacturing sequence.

Also, the nonwoven insulation blanket disclosed in the noted prior art patent has been found to be susceptible to damage. For example, the blanket can easily be torn during initial installation of the burner.

Accordingly, it is a primary aim of the present invention to provide a gas-fired radiant burner which overcomes each of the aforementioned shortcomings without offsetting disadvantages.

SUMMARY OF THE INVENTION

A gas-fired radiant burner includes a gas-permeable matrix of refractory fiber material having a generally equal degree of porosity throughout. The matrix has an inner face, an outer face, and a gas non-permeable peripheral edge separating the faces. A plenum means is sealed against the periphery of the inner face of the matrix to supply a pressurized combustible gas thereto for burning at the outer face of the matrix.

In accordance with one aspect of the invention, a flexible blanket of thermal insulation material is wrapped around the outside of the plenum means to thermally insulate the plenum means, an edge portion of the blanket being biased against the edge of the matrix by a bent-over strip of deformable material, such as perforated sheet metal, fixed to the plenum and extending about the peripheral edge of the matrix. The bent-over strip also functions to retain the inner face of the matrix in position against the plenum.

In accordance with a further aspect of the present invention, the flexible blanket of thermal insulation material is comprised of an inner layer of nonwoven, high-temperature-resistant fibers and an outer layer of woven material of high-temperature resistance, the woven outer layer being abrasion-resistant to protect the non-woven inner layer.

In accordance with a still further aspect of the present invention, the back wall of the plenum, which has a boxlike shape, has fixed to it a platelike gas diffuser overlying the combustion gas inlet and a substantial portion of the back wall. The gas diffuser is spaced from the back wall by integral pedestal mounts provided at its corners, and lies in a plane parallel to said back wall. The combustible gas provided via the inlet is diverted by the diffuser toward the side walls of the boxlike plenum to effect cooling thereof.

BRIEF DESCRIPTION OF THE DRAWINGS

A fuller understanding of the invention may be had by referring to the following description and claims taken in conjunction with the accompanying drawings, wherein:

DETAILED DESCRIPTION OF THE PREFERRED EMBODIMENT

Figure 1:
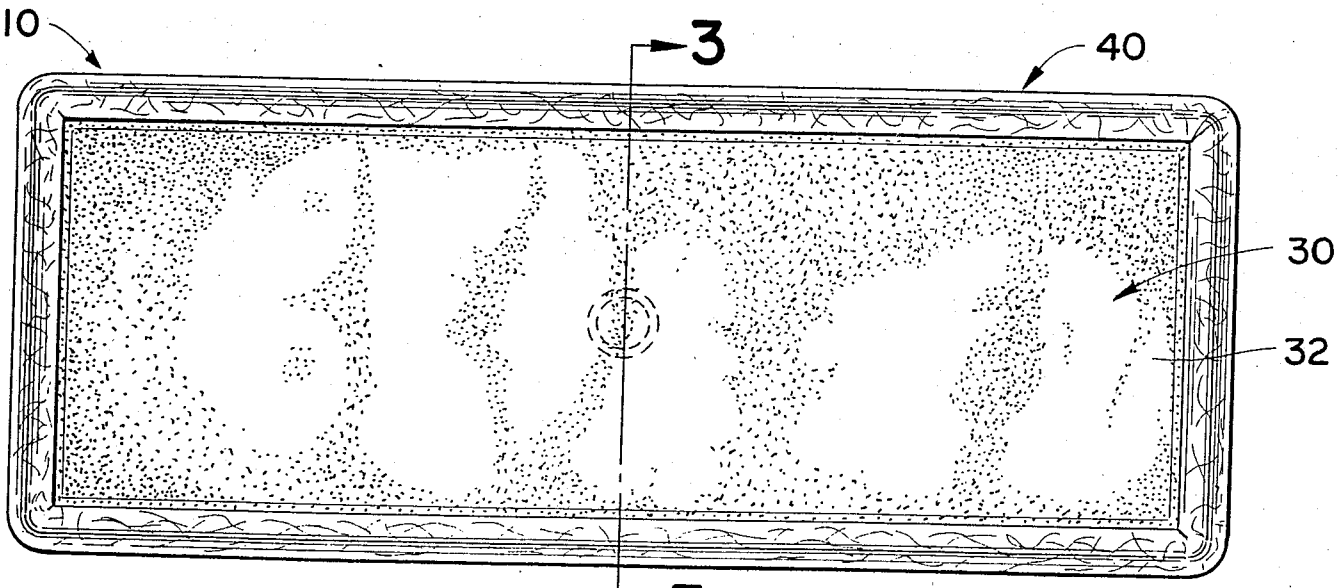
FIG. 1 is a front view of a radiant burner in accordance with the present invention.

In accordance with the present invention, and with particular reference to FIG. 1, there is illustrated a gas-fired radiant burner 10 having a rectangular, boardlike heating element 30 comprised of a porous matrix of refractory fibers. A suitable refractory material of the subject type is manufactured and sold by Johns-Manville Corporation of Denver, Colo., U.S.A., marketing such material under the trade name "Cera Form" and "Fiberchrome." Such boards are manufactured from refractory fibers and a multicomponent binder system. The composition of a Cera Form type board is approximately 36% alumina, 54% silica, and 3.5% chromic oxide. The specific density is 13.5 pounds per cubic foot, and the specific thermal conductivity is from 0.28 BTU per inch, hour, square foot at 400° F. (204° C.) to 1.98 at 2000° F. (1093° C.). A typical matrix board of this type is from about 1.0 inch to about 2.0 inches (2.54 cm −5.0 cm). The boardlike heating element 30, commonly referred to as a matrix, has a rectangular outer face 32 where a gas mixture is burned to provide a high degree of infrared radiation, as is well known in the art.

A flexible blanket of thermal insulation material 40 is wrapped around and generally covers all outer exposed surfaces of the radiant burner 10 but for the infrared radiating face 32 of the boardlike heating element 30. The composition and structure of the blanket of thermal insulation material 40 will be subsequently discussed in greater detail.

Figure 2:
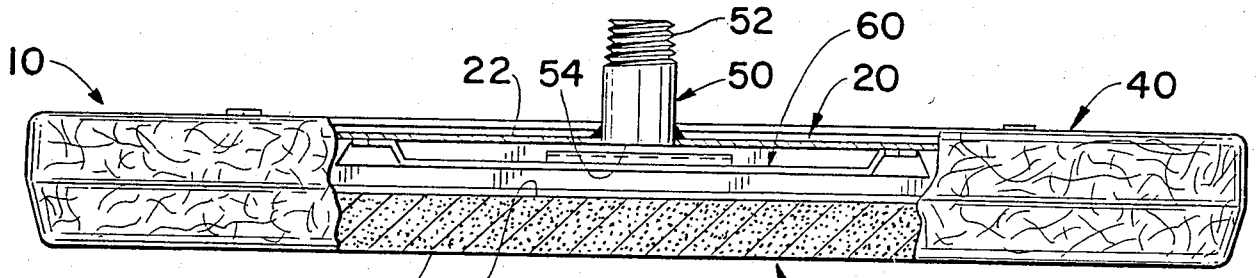
FIG. 2 is a top view of the burner of FIG. 1 with portion cut away.

With reference to FIG. 2, the boardlike matrix or heating element 30 can be seen to include an inner face 31 which is supplied with a pressurized, combustible gas mixture by a plenum means in the form of a sheet metal box 20 having an open end closed by the matrix. A back wall 22 (parallel to the matrix) of the sheet metal box 20 supports at its central portion a combustible gas mixture inlet conduit 50 having a distal threaded end 52, for connection to a combustible gas mixture source, and an inner end 54 fixed in fluidtight relationship to the back wall 22 by means of welding or the like, the gas inlet conduit 50 being in fluid communication with the interior volume of the plenum means defined by the sheet metal box 20. A gas diffuser 60, mounted inside the box 20 and lying in the plane parallel to the back wall 22, overlies the gas inlet 50 and a substantial portion of the rear wall 22, wherein pressurized combustible gas fed into the box 20 via the gas inlet 50 is dispersed within the sheet metal box 20 by the diffuser 60 for pressurized feeding through the porous boardlike heating element 30 and burning on the outer face 32 thereof.

Figure 4:
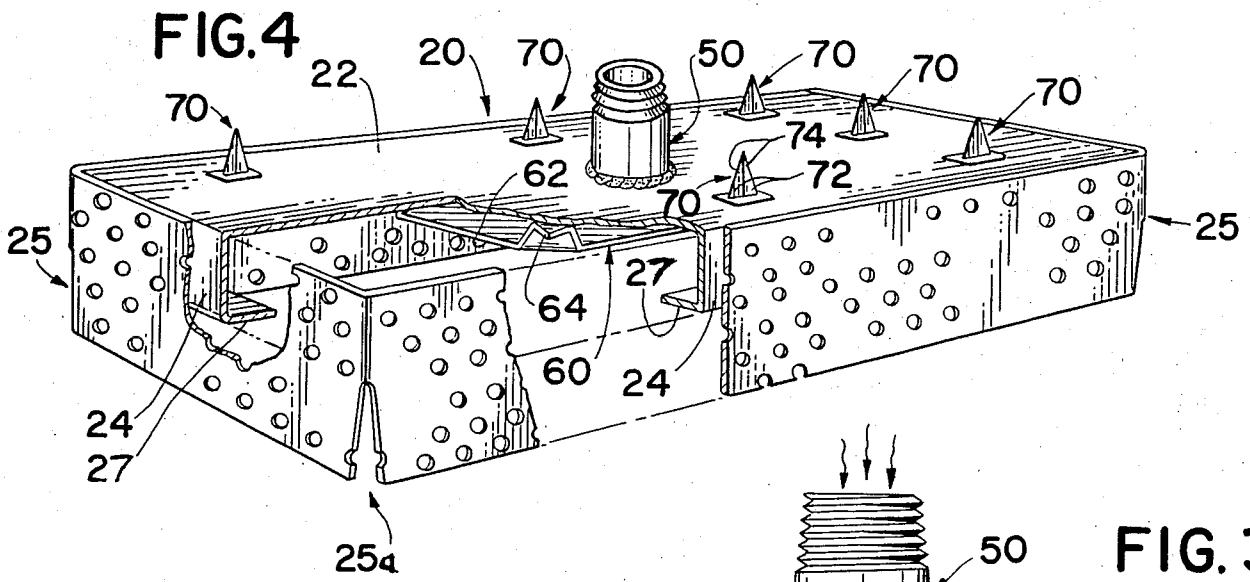
FIG. 4 is a perspective view of the burner of FIG. 1 with portions removed and cut away.
Figure 3:
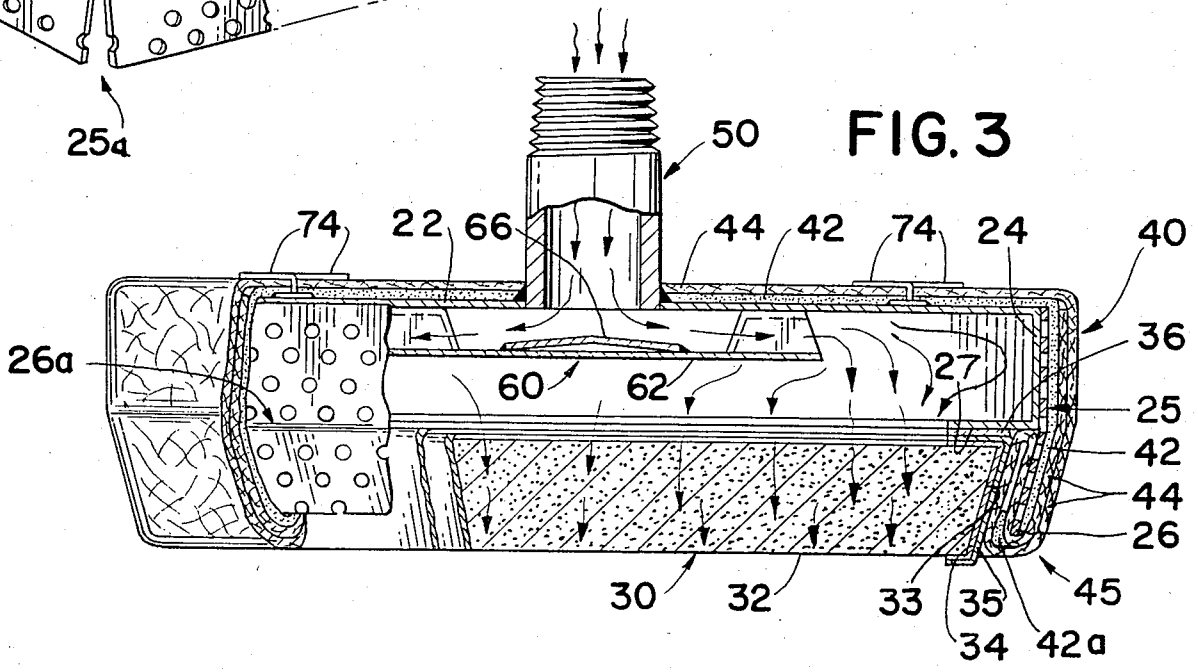
FIG. 3 is a partial cross section view of the burner of FIG. 1 taken along line 3—3 thereof.

With reference to FIGS. 3 and 4, a beveled peripheral edge 33 of the heating element 30, separating the inner and outer faces 31,32, is sealed to preclude the escape of gas therefrom. The seal is comprised of a first layer 34 of a refractory sealing and penetrating compound, such as Ludox HS-40, manufactured by E. I. DuPont de Nemours & Company, Inc., of Wilmington, Del., U.S.A. Ludox HS-40 is an aqueous, colloidal silica dispersion of discrete particles of surface hydroxylated silica that is alkali-stabilized. The silica layer 34 slightly penetrates the edge portion 33 of the heating element 30 to establish a gas-nonpermeable barrier. Over the first layer 34, a second layer 35 is applied, the second layer comprising a mixture of equal parts of alumina-silicate refractory cement, such as White Line Cement, manufactured by Fireline, Inc., of Youngstown, Ohio, U.S.A., and a colloidal silica, such as the earlier-noted Ludox HS-40. White Line Cement is an alumina-silicate mixed with about 50% colloidal silica. The White Line Cement-Ludox mixture serves to stiffen the matrix edge to maintain the integrity of the first layer 34. The layers 34, 35 (the thicknesses of which have been enlarged for illustration purposes) are applied to the continuous peripheral edge 33 of the heating element 30, and are allowed to dry prior to assembly of the heating element 30 with the sheet metal box 20.

As shown most clearly in FIG. 4, the sheet metal box 20, having its rectangular rear wall 22 supporting the gas inlet 50, includes four sidewalls 24 (only two shown) extending perpendicularly from the rear wall 22, an inwardly extending heating element mounting flange 27 being supported by the sidewalls 24, the flange 27 being parallel to and spaced from the back wall 22, as illustrated.

Fixed to the outside of the sidewalls 24 is a generally continuous strip of deformable material, such as a perforated sheet metal strip 25 spot welded to the exterior of the sidewalls 24. As illustrated in FIG. 4, the strip 25 extends beyond the flange 27 by a distance approximately equal to the thickness of the matrix.

With further reference to FIGS. 3 and 4, in assembling the radiant burner of the present invention, the heating element 30, having its edge 33 previously sealed by layers 34 and 35, has the periphery of its inner face 31 bonded in fluidtight relation to the mounting flange 27 by a layer 36 of rubberlike cement such as high-temperature-resistant silicon cement, Catalogue No. 732-C1 111, manufactured by Dow-Corning, Inc. of Midland, Mich., U.S.A.

It is noted that the above-discussed method of sealing the peripheral edge 33 of the heating element 30 and the adhesion of the heating element 30 to the mounting flange 27 have been previously disclosed in applicant's previous U.S. Pat. Nos. 4,255,123 and 4,354,823.

With the heating element 30 bonded in fluidtight relation to the sheet metal box 20 by the cement layer 36, the blanket of thermal insulation material 40 is wrapped around the sheet metal box 20 and the strip 25.

The blanket 40 includes an inner layer 42 of nonwoven, high-temperature-resistant fibers. A suitable inner layer material is known as Kaowool, manufactured by the Babcock & Wilcox Company, of Augusta, Ga., U.S.A. The blanket 40 further includes an outer layer 44 of woven material of high-temperature resistance, the woven outer layer being abrasion-resistant to protect the nonwoven inner layer. The outer layer 44 can, for example, be comprised of Fibersil cloth. Fibersil cloth is manufactured by the Carborundum Company, of Niagara Falls, N.Y., U.S.A.

The multilayer thermal blanket 40, having the inner layer 42 and the outer layer 44, has been found to be very durable while still providing excellent thermal insulation properties to shield the sheet metal box 20 from high temperature gases emitted from the burning outer face 32 of the heating element 30, thermal insulation of the box 20 being necessary to preclude rapid expansion and contraction of the box 20, which could cause the breaking away of the heating element 30 from the flange 27, or could cause other mechanical failures.

The blanket 40 is folded so as to cover the strip 25 as illustrated, the forward edge portion 45 of the outer layer 44 being doubled up and stuffed into the space or channel between the beveled peripheral edge 33 of the heating element 30 and the forward edge 26 of the sheet metal strip 25, the Fibersil material forming layer 44 being in contiguous relationship with the edge 33. The forward edge of the inner layer 42 of the blanket 40 abuts the forward edge 26 of the strip 25, a separate strip **42*a* of inner layer material (e.g., Kaowool) being positioned as illustrated intermediate the double outer layers 45 between the forward edge 26 of the strip 25 and the peripheral edge 33 of the heating element 30. The strip 42*a* serves to insulate the forward edge 26 from overheating by the burning face 32** of the matrix.

With the forward edge portion 45 of the two-layer blanket 40 (and strip **42*a*) stuffed into the space or channel between the forward edge 26 of the strip 25 and the peripheral edge 33 of the heating element 30, the forward edge 26 is bent over inwardly (along fold line 26*a*) towards the beveled peripheral edge 33 to sandwich and compress, between the edge 26 and the edge 33, the forward edge portion 45 of the blanket 40**.

The bent-over forward edge 26 of the strip 25, which is generally parallel to the beveled edge 33 of the matrix 30, applies a generally constant biasing force at generally all points about the peripheral edge 33 of the rectangular matrix, the corners **25*a* (only one shown-FIG. 4) of the strip being slotted to permit them to be bent over. This biasing force retains the blanket in position around the peripheral edge 33 of the heating element 30, and also serves to maintain the inner face of the heating element 30 in fluidtight position against the plenum means constituted by the sheet metal box 20. Since a generally constant biasing force is provided by the generally continuous bent-over strip 25, localized heating or hot spots about the peripheral edge of the matrix are less likely, due in part to the fact that the insulation matrial, constituted by blanket 40 (including portion 42*a*) stuffed into the channel between the edge 33 and the forward edge 26 of the strip 25, is compressed to an equal degree throughout its extent about the edge of the heating element. This is in contrast to the earlier-noted prior art U.S. Pat. No. 4,354,823, wherein a plurality of discrete clips compressed the insulation at discrete points about the peripheral edge of the matrix, thus raising the possibility of hot spots developing about the heating element periphery. It is also noted that the use of perforated sheet metal for the strip 25 lowers the rate of heat transfer from the front edge 26 to the box sidewalls 24 and flange 27, thus advantageously minimizing the heating of the interface area between the box 20 and the heating element 30, i.e., the area of seal layer 36**.

The back wall 22 of the box 20 includes a plurality of projections 70 formed, for example, as split metal tabs each comprising a pair of adjacent triangular sections as illustrated. The base portions 72 of the adjacent triangular sections forming each projection 70 are fixed to the back wall 22 (such as by spot welding).

The remaining portions of the precut blanket are wrapped around the four sides of the sheet metal box 20 and are pushed down over the projections 70 wherein the apex portions 74 of the triangular sections puncture through the two layers of the blanket 40. As illustrated most clearly In FIG. 3, the apex portions 74 of the triangular sections are then bent over in opposite directions relative to each other to sandwich portions of the blanket 40 between the bent apex portions 74 and the back wall 22 to thus retain it in position, as illustrated.

With further reference to FIGS. 3 and 4, the gas diffuser 60 can be seen to include a rectangular metal plate 62 having its four corners (only one shown in FIG. 4) bent to form pedestal portions 64 that are, for example, spot welded to the back wall 22 of the box 20, the pedestal portion 64 serving to space the major portion of the rectangular plate 62 from the back wall 22 of the box 20. As shown in FIG. 3, at the central portion of the plate 62 between the inlet 50 and the plate 62, there is provided a baffle element 66 that is, for example, spot welded to the plate 62. The baffle element 66 has a shallow, inverted V-shape as viewed in FIG. 3.

The gas diffuser 60 functions to force the incoming combustion gas to be diverted towrd the sidewalls 24 of the plenum means to effect cooling thereof. Thus, the diffuser 60 functions not only in the sense of the conventional baffle, to disperse the incoming gas mixture evenly throughout the plenum defined by the box 20, but also serves as a means for cooling the inner walls of the box 20 by a scrubbing type action prior to the escape of the pressurized combustion gas through the heating element 30 for burning at the outer face 32.

The construction of a gas-fired radiant burner as illustrated and discussed above with regard to FIGS. 1 through 4 is relatively simple and low in cost from both a manufacturing and materials standpont. It is contemplated that the burner manufactured in accordance with the present invention will be of such low cost as to be considered disposable when the radiant heating element 30 burns out at the end of its useful life. Thus, instead of replacing the heating element 30, as is currently the practice in the art, the user will simply throw out the complete burner unit and replace it with a new one.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described not in any other way that is inconsistent with the extent to which the progress in the art has been advanced by the invention.

What is claimed is:

1. In a gas-fired radiant burner including a gas-permeable matrix of refractory fiber material having a generally equal degree of porosity throughout, the matrix having an inner face, an outer face, and a gas nonpermeable peripheral edge separating the faces, the burner further including a plenum means sealed against the periphery of the inner face of the matrix to supply a pressurized combustible gas thereto for burning at the outer face of the matrix, the burner further including a flexible blanket of thermal insulation material wrapped around the outside of the plenum means to thermally insulate the plenum means from high temperature gas byproducts generated by said burning, an edge portion of the blanket being biased against the edge of the matrix, the improvement wherein the blanket is comprised of an inner layer of nonwoven high-temperature-resistant fibers and an outer layer of woven material of high-temperature resistance, said woven outer layer being abrasion-resistant to protect said nonwoven inner layer.

2. A gas-fired burner according to claim 1, wherein said edge portion of the blanket biased against the edge of the matrix includes a portion of said woven outer layer in contiguous relation with the edge of the matrix.

3. A gas-fired burner according to claim 1, including deformable tablike projections fixed to the plenum means, the projections piercing the blanket and being deformed to sandwich between the plenum means and the deformed portions of the projection a portion of the blanket whereby the blanket is retained in position about the plenum means.

4. A gas-fired burner according to claim 3, wherein the projections are constituted by sheet metal tabs each comprised of a pair of adjacent triangular sections having their base portions fixed to the plenum, the apex portions of the triangular sections being bent over in opposite directions to each other, portions of the blanket being clamped between the bent-over apex portions of the triangular sections and the plenum means.

* * * * *